US011674393B2

(12) United States Patent
Chen et al.

(10) Patent No.: US 11,674,393 B2
(45) Date of Patent: Jun. 13, 2023

(54) METHOD FOR CONSTRUCTING DAM INSIDE DUMP OF INNER-DUMP STRIP MINE

(71) Applicants: China University of Mining and Technology, Xuzhou (CN); State Energy Investment Group Co. LTD, Beijing (CN); Jiangsu Vocational Institute of Architectural Technology, Xuzhou (CN)

(72) Inventors: Shuzhao Chen, Xuzhou (CN); Quansheng Li, Beijing (CN); Liu Han, Xuzhou (CN); Cangyan Xiao, Xuzhou (CN)

(73) Assignees: China University of Mining and Technology, Xuzhou (CN); State Energy Investment Group Co. LTD, Beijing (CN); Jiangsu Vocational Institute of Architectural Technology, Xuzhou (CN)

( * ) Notice: Subject to any disclaimer, the term of this patent is extended or adjusted under 35 U.S.C. 154(b) by 0 days.

(21) Appl. No.: 17/656,423

(22) Filed: Mar. 25, 2022

(65) Prior Publication Data

US 2022/0333486 A1 Oct. 20, 2022

(30) Foreign Application Priority Data

Apr. 14, 2021 (CN) ..... 202110399093.X

(51) Int. Cl.
*E02B 7/02* (2006.01)
*E21F 16/00* (2006.01)

(52) U.S. Cl.
CPC ..... *E21F 16/00* (2013.01); *E02B 7/02* (2013.01)

(58) Field of Classification Search
CPC . E21F 16/00; E02B 7/02; E02D 17/18; E02D 3/12; E02D 31/00
See application file for complete search history.

(56) References Cited

U.S. PATENT DOCUMENTS 946,841 A * 1/1910 Gilman ..... E02D 19/04 405/11
3,526,096 A * 9/1970 Casagrande ..... E02D 17/18 405/21

(Continued)

*Primary Examiner* — Benjamin F Fiorello
(74) *Attorney, Agent, or Firm* — Bayramoglu Law Offices LLC

(57) ABSTRACT

A method for constructing a dam inside a dump of an inner-dump strip mine includes: taking an upper surface connection line of a primary water-resisting layer as upper filling reference datum boundary of an artificial water-resisting layer; arranging a dam foundation pit and a trapezoidal abutment on a midline of the dam foundation pit; building and reinforcing a step-shaped retaining dam core wall on the artificial water-resisting layer; laying a foundation impervious layer, waterproof geotextile, and an earth blanket on one side, close to the primary aquifer, of the retaining dam core wall; strengthening advance of a dumping working face on one side, away from the primary aquifer, of the retaining dam core wall, and dumping overburden of a strip mine to form a support; filling a space between the earth blanket and the primary aquifer to form a blocker; and proceeding with construction and forming a continuous retaining dam.

7 Claims, 3 Drawing Sheets

(56) References Cited

U.S. PATENT DOCUMENTS

| | | | | |
|---|---|---|---|---|
| 4,784,522 | A * | 11/1988 | Mraz | E21F 17/103 299/11 |
| 5,139,853 | A * | 8/1992 | Mathieson | E02D 31/00 428/131 |
| 8,381,814 | B2 * | 2/2013 | Lockhart | E21B 33/138 166/305.1 |
| 10,815,631 | B1 * | 10/2020 | Jia | E02B 7/06 |
| 2010/0215441 | A1 * | 8/2010 | Saadatmanesh | E02B 3/10 405/266 |
| 2012/0201606 | A1 * | 8/2012 | Dudding | E02D 17/18 405/129.6 |
| 2018/0340305 | A1 * | 11/2018 | Ragsdale, Jr. | E02D 17/18 |

* cited by examiner

METHOD FOR CONSTRUCTING DAM INSIDE DUMP OF INNER-DUMP STRIP MINE

CROSS REFERENCE TO THE RELATED APPLICATIONS

This application is based upon and claims priority to Chinese Patent Application No. 202110399093.X, filed on Apr. 14, 2021, the entire contents of which are incorporated herein by reference.

TECHNICAL FIELD

The present invention relates to a method for constructing a water blocking dam, in particular to a method for constructing a dam inside a dump of an inner-dump strip mine.

BACKGROUND

Strip mining can expose shallow aquifers easily since it can reach as deep as 200-300 m, which not only causes waste of water resources, but affects safety of strip mine production, and incurs production cost of mines due to artificial drainage in the case of groundwater inflow into strip mining areas. Although internal dumps formed after strip mining can bury the aquifers and block groundwater loss to a certain extent, dump material accumulation formed during normal dumping of strip mines develops pores, has desirable connectivity, and poor cementation and anti-seepage effects, and is permeable to water, thus reducing stability of dump slopes and causing potential safety hazards. However, earth and rockfill dams in water conservancy projects are strictly controlled during construction in terms of material selection, construction apparatuses, operation methods, etc., and cause many problems, such as great influence on normal production, long construction period and high cost when applied in the strip mine dumps. To this end, it is urgent to develop a method for constructing a dam in the strip mine dump coordinated with stripping dumping of the strip mine to prevent water in strata from permeating into the dumps.

SUMMARY

In order to solve the problems in the prior art, the present invention provides a method for constructing a dam inside a dump of an inner-dump strip mine, which is coordinated with strip mining and dumping, and achieves desirable water blocking effect, high reliability of the dam, little influence on production and low cost.

To achieve the above objective, the present invention provides the following technical solution, a method for constructing a dam inside a dump of an inner-dump strip mine includes:

step 1) taking an upper surface connection line of a primary water-resisting layer exposed on a stope slope of the strip mine as an upper filling reference datum boundary of an artificial water-resisting layer, filling and forming the artificial water-resisting layer with cementitious overburden in the stratum of a strip mine, and connecting the filled artificial water-resisting layer to the primary water-resisting layer exposed on the stope slope of the strip mine to form a continuous water-resisting layer in an internal dump of the strip mine;

step 2) arranging a continuous dam foundation pit at a position, 20 m away from a center point of a vertical section of a primary aquifer, in a pit of the strip mine in an extension direction of the stope slope of the strip mine, and arranging a continuous trapezoidal abutment on a midline of the dam foundation pit in the extension direction of the stope slope of the strip mine;

step 3) building a step-shaped retaining dam core wall on the artificial water-resisting layer, and arranging a reinforcing mesh and interconnected grouting pipelines in the retaining dam core wall by selecting an earth-rock mixture with desirable water stability in the strip mine as a raw material;

step 4) after the building of the retaining dam core wall, injecting cement grout into the grouting pipelines to cement the materials inside the retaining dam core wall into a whole;

step 5) laying a foundation impervious layer on one side, close to the primary aquifer, of the retaining dam core wall by selecting overburden with strong cementation in the strip mine as a raw material, and performing leveling, compaction, stone removing; laying waterproof geotextile on an outer surface of the foundation impervious layer from top to bottom; and laying an earth blanket on a surface of the waterproof geotextile by selecting the clay overburden with strong cementation in the strip mine as a raw material, sprinkling water for wetting the overburden, and compacting the overburden to promote its cementation;

step 6) strengthening advance of a dumping working face on one side, away from the primary aquifer, of the retaining dam core wall, and dumping overburden of the strip mine to form a support;

step 7) filling a space between the earth blanket and the primary aquifer with the overburden with strong cementation in the strip mine to form a blocker; and step 8) proceeding with construction and dumping into the dump through the above steps, and burying facilities formed in the above steps inside the dump to form a continuous retaining dam.

Further, the primary water-resisting layer exposed on the stope slope of the strip mine in step 1 is trimmed into a plurality of steps.

Further, a level of an upper surface of the abutment in step 2 is lower than a level of an upper surface of the primary aquifer.

Further, the retaining dam core wall in step 3 is rolled layer by layer from bottom to top, a level of an upper surface of the retaining dam core wall is higher than that of the upper surface of the primary aquifer, a slope of the side, close to the primary aquifer, of the retaining dam core wall is 1:4-1:3, and a slope of the other side is a natural repose angle with a slope of 1:1.5.

Further, the grouting pipelines in step 3 are arranged in layers, a plurality of branch pipelines are arranged on each layer at intervals in a horizontal direction, sub-branch pipelines are arranged alternatively on a circumference of the branch pipe, all the branch pipelines are connected to a trunk pipeline, and a top of trunk pipeline extending outside of the retaining dam core wall.

Further, holes are drilled in the branch pipeline and the sub-branch pipeline.

Further, filling space of the artificial water-resisting layer in step 1 is 15-20 m below the upper filling reference datum boundary, and a filler is made of a mudstone material which is easy to cement in the strip mine.

Further, the foundation impervious layer in step 5 has a thickness of 3-5 m, and surface relief not larger than 5 cm; and the earth blanket has a thickness of 1-1.5 m.

Compared with the prior art, the present invention may reduce leakage of groundwater, reduce drainage cost of the strip mine, reserve valuable water resources for ecological restoration around the mining area and industrial and agricultural production, and reduce the risk of slope instability caused by groundwater seepage by constructing the water retaining dam as soon as possible instead of using the natural compaction and seepage resistance after the overburden is dumped. The dam is constructed by using the overburden of a primary stratum during strip mine mining, so as to avoid the groundwater pollution problem that may be caused by introduction of a large number of external substances. Dam construction is coordinated with the strip mine dumping, which reduces influence on the strip mine production and facilitates the stability of the dam. Grouting inside the dam may improve strength, three anti-seepage layers on the surface improve the water blocking effect, and a base, the abutment and the support of the dam may be combined to improve the reliability of the dam. Filling the space between the dam and the slope with the blocker may block leakage channels of water as soon as possible, thus achieving high reliability. The dam and the blocker are all arranged at extremely high levels, so structure reliability is improved.

In the figures: 1—stope slope of the strip mine; 2—primary water-resisting layer; 3—artificial water-resisting layer; 4—dam foundation pit; 5—abutment; 6—retaining dam core wall; 7—grouting pipeline; 701 trunk pipeline; 702—branch pipeline; 703—sub-branch pipeline; 704—hole; 8—foundation impervious layer; 9—waterproof geotextile; 10—earth blanket; 11—support; 12—blocker; and 13—primary aquifer.

DETAILED DESCRIPTION OF THE EMBODIMENTS

The present invention will be further described below with reference to accompanying drawings.

The technical solutions in embodiments of the present invention will be clearly and completely described below with reference to accompanying drawings in the embodiments of the present invention. Apparently, the described embodiments are merely some rather than all of the embodiments of the present invention. All other embodiments obtained by a person of ordinary skill in the art based on the embodiments of the present invention without creative efforts shall fall within the protection scope of the present invention.

Figure 1:
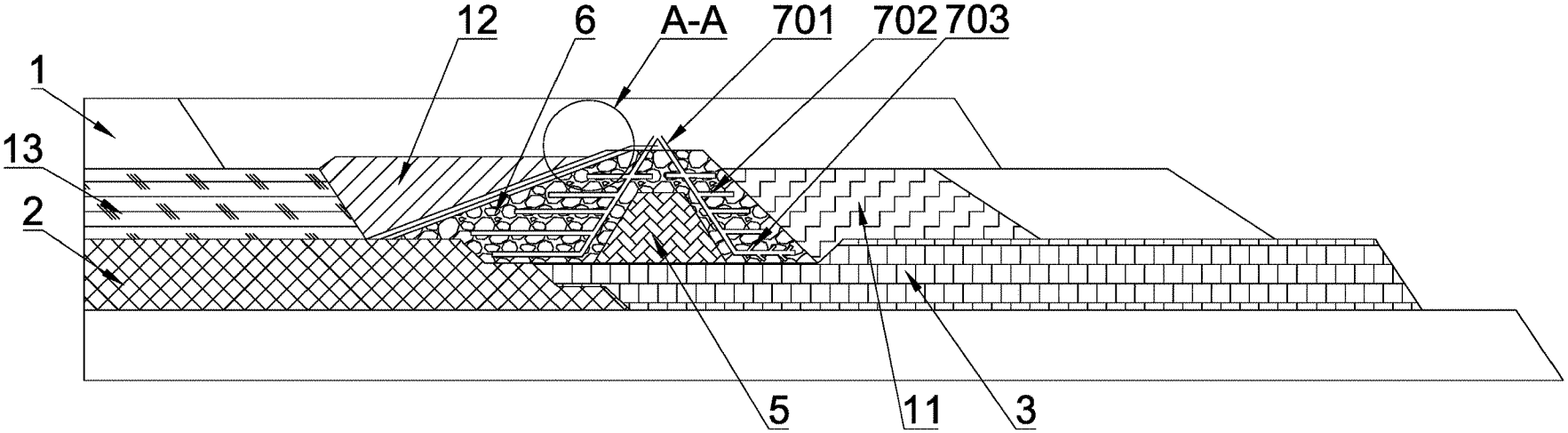
FIG. 1 is a sectional view of the present invention.
Figure 2:
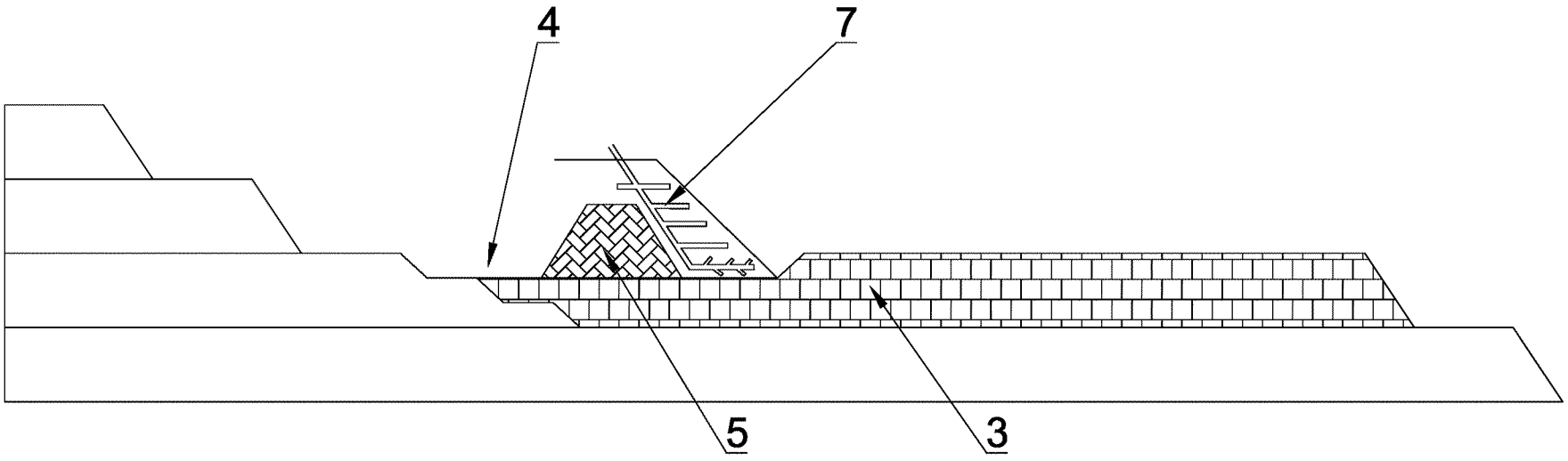
FIG. 2 is a construction process diagram of the present invention.

As shown in FIGS. 1 and 2, the present invention provides a technical solution:

Step 1, after strip mining, an upper surface connection line of a primary water-resisting layer 2 exposed on a stope slope of the strip mine 1 is taken as an upper filling reference datum boundary of an artificial water-resisting layer 3, space 15-20 m below the upper filling reference datum boundary is filled with a mudstone material which is easy to cement in the strip mine as a filler to form the artificial water-resisting layer 3. The filled artificial water-resisting layer 3 is abutted onto the primary water-resisting layer 2 exposed on the stope slope of the strip mine 1 to form a continuous water-resisting layer in an internal dump of the strip mine, so as to block a seepage channel of water inside the dump and avoid formation of a continuous weakened layer in the dump due to water seepage. The primary water-resisting layer 2 exposed on the stope slope of the strip mine 1 is trimmed into a plurality of steps with 5 m heights and 5 m widths before the artificial water-resisting layer 3 is filled, and a width of an uppermost step is not less than 3 times the height. Step-pattern arrangement may effectively expand a contact area between the primary water-resisting layer 2 and the artificial water-resisting layer 3 and improve the connection effect of the contact surface.

Step 2, a continuous dam foundation pit 4 is arranged at a position, 20 m away from a center point of a vertical section of a primary aquifer 13, in a pit of the strip mine in an extension direction of the stope slope of the strip mine 1. A length of the dam foundation pit 4 is continuously extended with continuous advance of the strip mine, a bottom width of the dam foundation pit 4 is four times the design height of the dam plus a top width of the dam, and a depth of the dam foundation pit 4 is 5 m. A continuous trapezoidal abutment 5 is arranged on a midline of the dam foundation pit 4 in the extension direction of the stope slope of the strip mine 1. A bottom width of the trapezoidal abutment 5 equals a design height of the dam plus a top width of the dam, a top width equals the top width of the dam, a level of an upper surface of the trapezoidal abutment 5 is smaller than a level of an upper surface of the primary aquifer 13 by 5 m. The abutment 5 is in a reinforced concrete structure, and a depth of internal rebar vertically penetrating downwards into the artificial water-resisting layer 3 is 3-5 m, which provides a foundation for next construction of the retaining dam core wall 6. The retaining dam core wall 6 is built on the basis of the abutment 5. The abutment 5 is designed to improve the strength of the retaining dam 6. If all water retaining dams are made of reinforced concrete, the optimal strength is achieved, but high cost is caused accordingly, so for reducing the cost on the basis of strength guarantee, only a middle core is in a reinforced concrete structure.

Step 3, the step-shaped retaining dam core wall 6 is built on the artificial water-resisting layer 3, the retaining dam core wall 6 is rolled layer by layer from bottom to top, an earth-rock mixture with desirable water stability in the strip mine is selected as a raw material, the raw material is discharged through site dumping with a layered thickness of not more than 3 m, a level of an upper surface of the retaining dam core wall 6 is higher than that of the upper surface of the primary aquifer 13 by 7-10 m, a width of the upper surface of the retaining dam core wall 6 equals 1.5-2 times as large as a turning radius of a construction mining truck, but is not smaller than 10 m, a slope of the side, close to the primary aquifer 13, of the retaining dam core wall 6 is 1:4-1:3, and a slope of the other side is a natural repose angle with a slope of 1:1.5.

Figure 3:
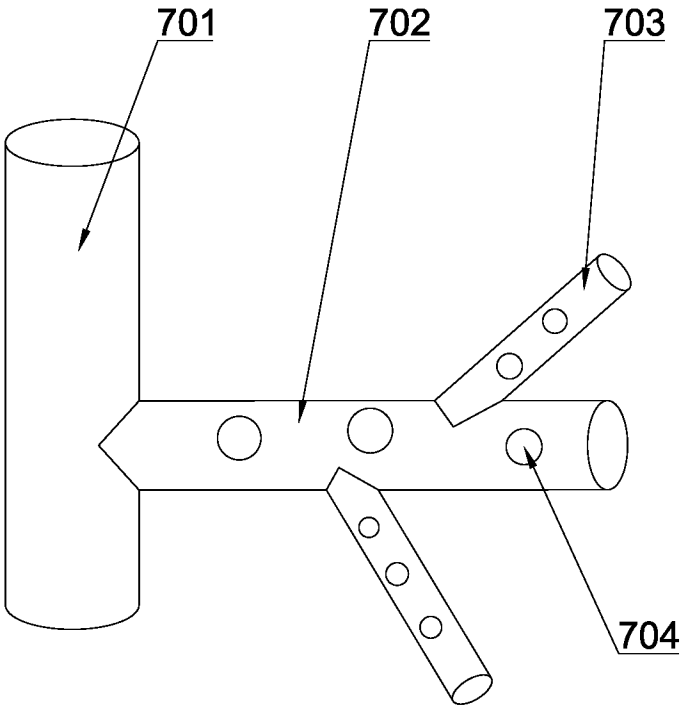
FIG. 3 is a structural schematic diagram of a grouting pipeline of the present invention.

During construction, a reinforcing mesh and interconnected grouting pipelines 7 are arranged in the retaining dam core wall 6. As shown in FIG. 3, the grouting pipelines 7 are arranged in layers in a layer-by-layer topology manner, which are divided into layers every 2-3 m in a vertical direction, branch pipelines 702 are arranged on each layer at 3-5 m intervals in a horizontal direction, branch pipes 703 is arranged alternatively at an interval of 1 m on a circumference of the branch pipe 702. A plurality of 1 cm holes 704 are drilled evenly on the branch pipelines 702 and the sub-branch pipelines 703, all the branch pipelines 702 are connected to a trunk pipeline 701, and a top of the trunk pipeline 701 extends out of the retaining dam core wall 6. According to an extension length of the stope slope of the strip mine 1, 2-3 trunk pipelines 701 may be set. A hole 704 of a lowermost end of the grouting pipeline 7 is located on a surface of a dam foundation, and an uppermost hole 704 is located at 70% of a height of the retaining dam core wall 6.

Step 4, after the building of the retaining dam core wall 6, cement grout is injected into the grouting pipelines 7 to cement the materials inside the retaining dam core wall 6 into a whole, and the reinforcing mesh and the grouting pipelines 7 simultaneously play the role of reinforcing ribs.

Figure 4:
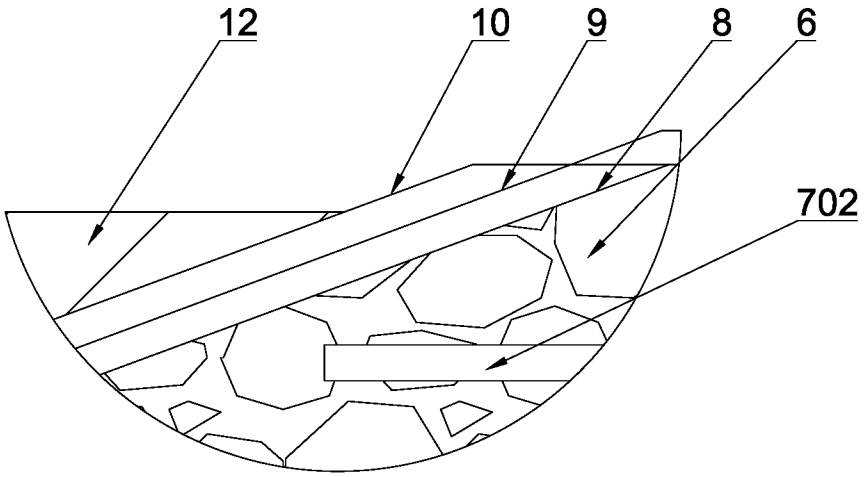
FIG. 4 is an enlarged view of position A-A in FIG. 1.

Step 5, as shown in FIG. 4, a foundation impervious layer 8 with a thickness of 2-3 m is laid on one side, close to the primary aquifer 13, of the retaining dam core wall 6 by selecting overburden with strong cementation in the strip mine as a raw material, leveling, compaction and stone removing are performed, on one hand, filling material pores of the dam plays an anti-seepage role, and on the other hand, leveling the surface of the dam facilitates the following laying of waterproof geotextile 9. The waterproof geotextile 9 is laid on an outer surface of the foundation impervious layer 8 from top to bottom. A bottom of the waterproof geotextile 9 is extended to the primary water-resisting layer 2, and a top of the waterproof geotextile 9 is extended to a middle of an upper surface of the retaining dam core wall 6, so as to strengthen the anti-seepage function. An earth blanket 10 is laid on a surface of the waterproof geotextile 9 by selecting the clay overburden with strong cementation in the strip mine as a raw material, and has a thickness not less than 1-1.5 m. A slope bottom line of the earth blanket 10 is connected to a bottom end of the primary aquifer 2 exposed on the stope slope, and after laying, water is sprinkled for wetting the overburden, and the overburden is compacted to promote its cementation into a whole.

Step 6, advance of a dumping working face on one side, away from the primary aquifer 13, of the retaining dam core wall 6 is strengthened, and overburden of the strip mine is dumped to form a support 11 to support the dam and balance internal and external pressure, so as to prevent the retaining dam core wall 6 from displacement and shear failure.

Step 7, a space between the earth blanket 10 and the primary aquifer 13 is filled with the overburden with strong cementation in the strip mine to form a blocker 12, which is rolled and formed layer by layer from bottom to top during construction, the materials are dumped through site dumping, with a layered thickness not exceeding 3 m, a level of an upper surface of the blocker 12 is 3 m higher than that of the upper surface of the primary aquifer 13, and the exposed primary aquifer 13 is covered to guarantee the water blocking effect.

Step 8, construction and dumping into the dump proceed according to the above steps, and facilities formed in the above steps are buried inside the dump to form a continuous retaining dam.

For those skilled in the art, it is apparent that the present invention is not limited to the details of the above exemplary embodiments, and the present invention can be implemented in other specific forms without departing from the spirit or basic features of the present invention. Therefore, no matter from which point of view, the embodiments should all be regarded as exemplary and non-limiting. The scope of the present invention is defined by the appended claims rather than the above description, and intends to cover all changes which fall within the meaning and scope of equivalent elements of the claims. Any reference sign in the claims should not be construed as limiting the related claims.

What is described above is merely the preferred embodiment of the present invention, and is not intended to limit the present invention. Any slight modification, equivalent replacement and improvement of the above embodiments according to the technical essence of the present invention should fall within in the protection scope of the technical solution of the present invention.

What is claimed is:

1. A method for constructing a dam inside a dump of an inner-dump strip mine, comprising the following steps:

1) taking an upper surface connection line of a primary water-resisting layer exposed on a stope slope of the strip mine as an upper filling reference datum boundary of an artificial water-resisting layer, filling the artificial water-resisting layer with a filler from materials in the strip mine to obtain a filled artificial water-resisting layer, and connecting the filled artificial water-resisting layer to the primary water-resisting layer exposed on the stope slope of the strip mine to form a continuous water-resisting layer in the internal dump of the strip mine;

2) arranging a continuous dam foundation pit at a position, 20 m away from a center point of a vertical section of a primary aquifer, in a pit of the strip mine in an extension direction of the stope slope of the strip mine, and arranging a continuous trapezoidal abutment on a midline of the continuous dam foundation pit in the extension direction of the stope slope of the strip mine;

3) building a retaining dam core wall on the artificial water-resisting layer, wherein the retaining dam core wall is step-shaped, and arranging a reinforcing mesh and interconnected grouting pipelines in the retaining dam core wall by selecting an earth-rock mixture in the strip mine as a first raw material;

4) after the building of the retaining dam core wall, injecting cement grout into the interconnected grouting pipelines to cement the first raw material inside the retaining dam core wall into a whole;

5) laying a foundation impervious layer on a first side, close to the primary aquifer, of the retaining dam core wall by selecting overburden with strong cementation in the strip mine as a second raw material; laying waterproof geotextile on an outer surface of the foundation impervious layer from top to bottom; and laying an earth blanket on a surface of the waterproof geotextile by selecting the overburden with the strong cementation in the strip mine as the second raw material;

6) strengthening advance of a dumping working face on a second side, away from the primary aquifer, of the retaining dam core wall, and dumping the overburden of the strip mine to form a support;

7) filling a space between the earth blanket and the primary aquifer with the overburden with the strong cementation in the strip mine to form a blocker; and 8) proceeding with construction and dumping into the internal dump of the strip mine through steps 1) to 7), and burying the dam formed in steps 1) to 7) inside the dump to form a continuous retaining dam.

2. The method according to claim 1, wherein a level of an upper surface of the continuous trapezoidal abutment in step 2 is lower than a level of an upper surface of the primary aquifer.

3. The method according to claim 1, wherein the retaining dam core wall in step 3 is rolled layer by layer from bottom to top, a level of an upper surface of the retaining dam core wall is higher than a level of an upper surface of the primary aquifer, a slope of the first side, close to the primary aquifer, of the retaining dam core wall is 1:4-1:3, and a slope of the second side, away from the primary aquifer, of the retaining dam core wall is a natural repose angle with a slope of 1:1.5.

4. The method according to claim 1, wherein the interconnected grouting pipelines in step 3 are arranged in layers and comprise a plurality of branch pipelines, sub-branch pipelines, and a trunk pipeline, the plurality of branch pipelines are arranged on each of the layers at intervals in a horizontal direction, the sub-branch pipelines are arranged alternatively on a circumference of each of the plurality of branch pipelines, all of the plurality of branch pipelines are connected to the trunk pipeline, and a top of the trunk pipeline extends outside of the retaining dam core wall.

5. The method according to claim 4, wherein a plurality of holes are drilled in the plurality of branch pipelines and the sub-branch pipelines.

6. The method according to claim 1, wherein a filling space of the artificial water-resisting layer in step 1 is 15-20 m below the upper filling reference datum boundary, and the filler comprises a mudstone material capable of cementation in the strip mine.

7. The method according to claim 1, wherein the foundation impervious layer in step 5 has a thickness of 3-5 m, and a surface relief not larger than 5 cm; and the earth blanket has a thickness of 1-1.5 m.

* * * * *